US006617784B1

(12) United States Patent
Abe et al.

(10) Patent No.: US 6,617,784 B1
(45) **Date of Patent: *Sep. 9, 2003**

(54) ELECTROLUMINESCENT DEVICE AND METHOD FOR PRODUCING THE SAME

(75) Inventors: Hidetoshi Abe, Tendo (JP); Yoshinori Araki, Sagae (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/424,722

(22) PCT Filed: Jun. 8, 1998

(86) PCT No.: PCT/US98/11321

§ 371 (c)(1),
(2), (4) Date: Nov. 30, 1999

(87) PCT Pub. No.: WO98/57525

PCT Pub. Date: Dec. 17, 1998

(51) Int. Cl.[7] ..... H05B 33/12; H05B 33/02; H05B 33/10; H05B 33/14

(52) U.S. Cl. ..... 313/506

(58) Field of Search ..... 313/501, 504, 313/506, 112, 116, 110; 362/84, 339; 315/169.3; 349/69, 33, 88, 86; 428/690, 917

(56) References Cited

U.S. PATENT DOCUMENTS 4,767,679 A * 8/1988 Kawachi ..... 428/690
5,019,748 A * 5/1991 Appelberg ..... 315/169.3
5,548,670 A * 8/1996 Koike ..... 385/27
5,592,332 A * 1/1997 Nishio et al. ..... 359/619
5,882,806 A * 3/1999 Mori ..... 428/690
5,966,192 A * 10/1999 Higuchi et al. ..... 349/61
6,107,364 A * 8/2000 Fong et al. ..... 522/182
6,157,486 A * 12/2000 Benson, Jr. et al. ..... 359/498
6,322,225 B1 * 11/2001 Koike ..... 362/31
6,441,551 B1 * 8/2002 Abe et al. ..... 313/503

FOREIGN PATENT DOCUMENTS

| | | |
|---|---|---|
| EP | 0 323 218 | 7/1989 |
| JP | 09 015596 | 1/1997 |
| JP | 09 054171 | 2/1997 |
| JP | 09 073983 | 3/1997 |
| JP | 09 326297 | 12/1997 |
| WO | WO88/04467 | 6/1988 |

* cited by examiner

*Primary Examiner*—Ashok Patel
(74) *Attorney, Agent, or Firm*—Carolyn A. Fischer

(57) ABSTRACT

An electroluminescent (EL) device is disclosed and includes an electroluminescent element (9) having a light-emitting surface (91), and a prismatic film (1) having a surface (11) on which a plurality of prisms are provided and a back surface (12) opposed to said surface (11) and being placed on said light-emitting surface (91), wherein the back surface (12) of the prismatic film (1) and said light-emitting-surface (91) of the electroluminescent element (9) are closely bonded optically. The EL device can effectively intensify the light which is emitted in the normal line direction and also in the direction deviating from the normal line, and increase the luminance in the wide observation angle range.

20 Claims, 1 Drawing Sheet

Fig. 1
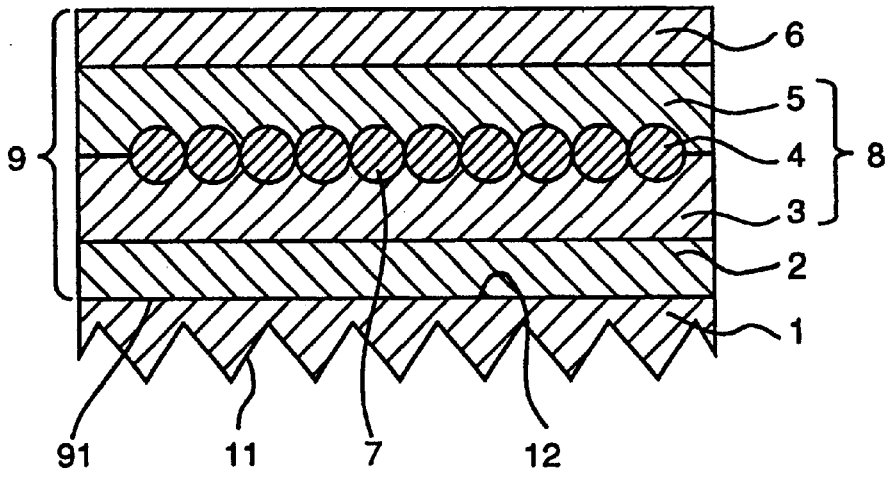
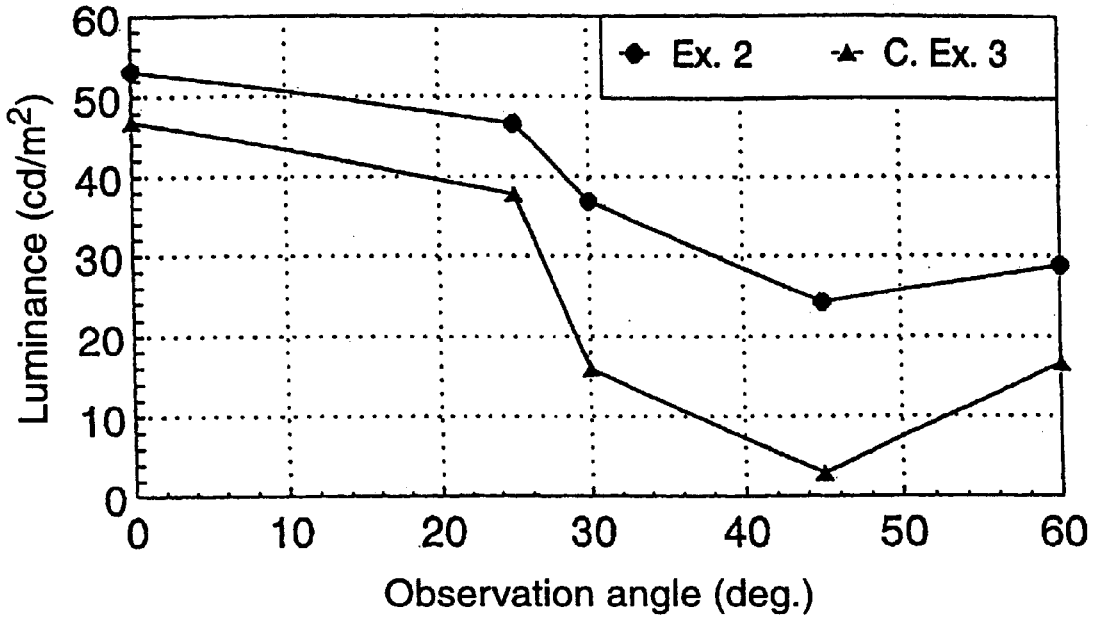
Fig. 2

ELECTROLUMINESCENT DEVICE AND METHOD FOR PRODUCING THE SAME

FIELD OF THE INVENTION

The present invention relates to an electroluminescent device (hereinafter referred to as "EL device") and a method for producing the same. In particular, the present invention relates to an EL device which uses a prismatic film effectively, and a method for producing the same.

BACKGROUND OF THE INVENTION

EL devices are known, which comprise a semiconductor luminescent layer or a so-called "dispersion type luminescent layer" that is formed by dispersing luminescent particles such as fluorescent substances in a matrix resin such as a polymer having a high dielectric constant.

For example, an EL device comprising a "dispersion type luminescent layer" can be formed by laminating a transparent substrate, a transparent electrode layer, an insulating layer consisting of a vinylidene fluoride base matrix resln, a luminescent layer comprising a vinylidene fluoride base matrix resin and fluorescent particles, the same insulating layer as above, and a rear electrode in this order, as disclosed in Japanese Patent Publication JP-B-59-14878.

Japanese Patent Publication JP-B-62-59879 discloses an EL device comprising a polyester film, an ITO electrode, a luminescent layer comprising a cyanoethylated ethylene-vinyl alcohol copolymer (a matrix resin) and fluorescent particles, and an aluminum toil (a rear electrode), which are laminated in this order.

In general, the both surfaces (a surface and back surface) of the transparent substrate which emits light from the luminescent layer are flat and smooth in these EL devices, and no means is provided for increasing the luminance through an optical function.

It is known from Japanese Patent Publication JP-A-5-94994 and the like that the luminance can be increased by placing a prismatic film having a surface carrying a plurality of prisms on the light-emitting surface of a planar luminescent body such as an EL device and utilizing the optical functions of the prisms.

SUMMARY OF THE INVENTION

The above structure can intensify the light emitted in the normal direction from the light-emitting surface, but cannot intensity the light effectively in the direction deviating from the normal line (for example, deviating by at least 30 degrees from the normal line). Thus, the increase of the luminance in a wide observation angle range cannot be expected. The reason for this has been found according to a results of the research by the present inventors. That is, the light in the direction deviating from the normal line is easily reflected by an air layer present at the interface between the luminescent layer and prismatic film, and an amount of light which reaches the prismatic film decreases.

The present invention provides an EL device which intensifies the light emitted in the normal line direction and also in the directions deviating from the normal line, and increases the luminance in the wide observation angle range.

Accordingly, the present invention provides an electroluminescent device comprising an electroluminescent element (9) having a light-emitting surface (91), and a prismatic film (1) having a surface (11) on which a plurality of prisms are provided and a back surface (12) opposed to said surface (11) and being placed on said light-emitting surface (91), wherein the back surface (12) of the prismatic film (1) and said light-emitting surface (91) of the electroluminescent element (9) are closely bonded optically.

The EL device of the present invention can effectively intensify the light emitted in the normal line direction from the light-emitting surface and directions deviating from the normal line, and increases the luminance in the wide observation angle range, since the back surface of the prismatic film (1) (that is, the surface having no prisms) and the light-emitting surface of the EL device (9) are closely bonded optically.

The prismatic film (1) and EL device (9) being "closely bonded optically" means that no air layer, which functions to decrease the amount of light which emitted from the EL device and reaches the prismatic film, is present between them. Such the closely bonded state can be easily formed particularly when the light-emitting surface of the EL device (9) is substantially flat, and also the back surface of the prismatic film (1) is substantially flat.

The optically closely bonded state can be achieved by:

A: coating the transparent conductive layer (2) directly on the back surface of the prismatic film (1) and then forming the luminescent layer (8) in close contact with the back surface of the transparent conductive layer (2), or B: adhering the prismatic film (1) and the EL element (9) through a transparent adhesive layer with leaving substantially no air layer between them.

In the latter case, the light transmission of the transparent adhesive should be at least 75%, preferably at least 80%, in particular at least 85%. The transparent adhesive may be an acrylic pressure-sensitive adhesive, acrylic heat-sensitive adhesive, etc.

Herein, the "light transmission" means a transmission of light measured using a UV/visible light spectrometer "V-560" manufactured by Nippon Bunko Kabushikikaisha at a wavelength of 550 nm.

The filling rate of the luminescent particles is easily increased and thus the luminance is further increased, when the luminescent layer (8) includes the luminescent particle layer (4) which consists essentially of particles containing the luminescent particles (7), is placed between the support layer (3) and the insulating layer (5) and is in close contact with the support layer (3) and the insulating layer (5).

The EL device can be advantageously produced by a method comprising the steps of:

i) providing a prismatic film (1) on the back surface (11) of which a transparent conductive layer (2) is laminated, ii) applying a paint for forming a support layer (3) containing matrix resin on said transparent conductive layer (2), scattering particles containing luminescent particles (7) in a layer state, and embedding a part of each particle in said paint prior to solidification of said paint, then, solidifying said paint and forming a transparent support layer (3) and a luminescent particle layer (4) bonded to said support layer (3), iii) applying a paint for forming an insulating layer (5) comprising an insulating material on said luminescent particle layer (4), solidifying said paint and forming said insulating layer (5) bonded to said luminescent particle layer (4), and iv) laminating a rear electrode (6) on said insulating layer (5).

This method can produce a sheet-form EL device having a high luminance and a large area, without using a dispersion paint of luminescent particles.

Further features and advantages of the invention will become apparent from a review of the embodiments of the invention in conjunction with the following drawings.

BRIEF DESCRIPTION OF THE DRAWING

FIG. 1 is a cross sectional view of an example of the EL device according to the present invention.

FIG. 2 is a graph showing the dependency of the luminance on the observation angle of the EL devices produced in Example 2 and Comparative Example 3.

EMBODIMENTS OF THE INVENTION

FIG. 1 shows the following elements: 1: Prismatic film, 2: transparent conductive layer, 3: support layer, 4: luminescent particle layer, 5: insulating layer, 6: rear electrode, 7: luminescent particles, 8: luminescent layer, 9: EL element.

FIG. 1 also discloses an electroluminescent element (9) having a light-emitting surface (91), and a prismatic film (1) having a surface (11) on which a plurality of prisms are provided and a back surface (12) opposed to said surface (11) and being placed on said light-emitting surface (91), wherein the back surface (12) of the prismatic film (1) and said light-emitting surface (91) of the electroluminescent element (9) are closely bonded optically.

An example of the EL element according to the present invention is a sheet-form EL element comprising the luminescent layer (8) which are interposed between the transparent conductive layer (2) and rear electrode (6), as shown in FIG. 1. The transparent conductive layer (2) of the example of FIG. 1 is coated directly on the flat back surface of the prismatic film (1) for forming a flat light-emitting surface, and allows the optically closely bonded state between the prismatic film and the EL element.

This example of the EL element is substantially the same as the conventional dispersion type EL element except that the prismatic film (1) is used in place of the outermost transparent substrate.

The luminescent layer (8), which will be explained in detail below, has a different structure from that of the dispersion type luminescent, and comprises the transparent support layer (3) comprising the matrix resin, the insulating layer containing the insulating material, and the luminescent particle layer (4) placed between the layers (3) and (5), which are laminated in close contact.

In general, the thickness of the whole EL device is in the range between 50 and 3000 $\mu$m.

Prismatic Film

The prismatic film is a film having a plurality of prismatic ridges which are provided in parallel with each other along one direction. Examples of such the prismatic film are "BEF 90HP", "BEF 1190/50", "BEF 11100/31 " and "BEF 1190/24" (all trade names of Minnesota Mining and Manufacturing Company (3M) of St. Paul, Minn., USA).

The prism angle (an angle of the apex of each ridge) of the prismatic film is usually between 70 and 120 degrees, preferably between 80 and 100 degrees. When the prism angle is too small, the observation angle tends to be narrow. When the prism angle is too large, the effects for increasing the luminance may deteriorate.

The distance between apexes of adjacent prisms (prism pitch) is usually between 10 and 400 mm, preferably between 20 and 100 mm. When the prism pitch is too small, the observation angle tends to decrease. When the prism pitch is too large, the effects for increasing the luminance may deteriorate.

The thickness of the prismatic film (the height from the back surface of the substrate to the apexes of the prismatic ridge) is usually between 50 and 600 mm, preferably between 100 and 300 mm.

The prismatic film is usually made of a resin. Examples of such the resin are polyester resins such as polyethylene terephthalate (PET), polyethylene naphthalate (PEN), etc.; acrylic resins such as polymethyl methacrylate, modified polymethyl methacrylate, etc.; fluororesins such as polyvinylidene fluoride, acrylmodified polyvinylidene fluoride, etc.; polycarbonate resins; vinyl chloride resins such as vinyl chloride copolymers; and the like.

The prismatic film depicted in FIG. 1 has a surface (11) on which a plurality of prismatic ridges are provided, and a substantially flat back surface (12). The prismatic film can be a single layer film as shown in FIG. 1, while it may be a multilayer film comprising a prismatic layer and other layer which is in contact with the flat surface of the prismatic layer. For example, whiteness of the light can increase, when one layer of the multilayer film has high transparency and contains a dye which develops a complimentary color to a color emitted by the luminescent layer. Preferably, examples of such the dye are red or pink fluorescent dyes such as rhodamine 6G, rhodamine B, perylene dyes, etc., when the emitted light from the luminescent layer is bluegreen.

The light transmission through the prismatic film is usually at least 60%, preferably at least 70%, in particular at least 80%.

The prismatic film may contain additives such as UV light absorber, moisture absorbents, colorants, fluorescent materials, phosphors, and the like, unless the effects of the present invention are impaired.

The cross sectional figure of the prism may be a triangle as described above, while it may be any arbitrary figure, unless the effect of the present invention are impaired. For example, the prism may be any one of cube-corner prisms (triangular pyramid), deformed prisms having rounded or truncated heads, curved surface prisms having semicircular or ellipsoidal cross sections, and the like.

Transparent Conductive Layer

The transparent conductive layer is preferably formed by coating it directly on the back surface of the prismatic film.

The transparent conductive layer may be any transparent electrode which is used in the dispersion type EL devices, such as an ITO (Indium-Tin Oxide) film, and the like. The thickness of the transparent conductive layer is usually between 0.1 and 1000 Km, and the surface resistivity is usually between 100 and 500, 92/square, preferably between 200 and 300 U/square. The light transmission is usually at least 70%, preferably at least 80%.

The ITO film is formed by any conventional film-forming method such as vapor deposition, sputtering, paste coating, and the like. The surface of the prismatic film may be treated with corona, and the like for facilitating the adhesion of the ITO film, and then coated with the ITO film.

In the example of FIG. 1, the transparent conductive layer is formed directly on the prismatic film, and no layer which absorbs or reflects light is present between the transparent conductive layer and the prismatic film. Such the structure is particularly effective for increasing the luminance of the light observed along the normal line direction from the light-emitting surface.

The uniform luminance in the wide observation angle is achieved, as long as the back surface of the prismatic film and the light-emitting surface of the EL element are in close contact optically. Thus, the structure of the EL device of the present invention is not limited to FIG. 1. For example, a transparent adhesive layer is formed on the prismatic film, and then the EL element having the transparent conductive layer is laminated on the adhesive layer. Alternatively, a primer layer is formed on the back surface of the prismatic film, and then the transparent conductive layer is coated on the primer layer. The thickness of the transparent adhesive or,primer layer is usually between 1 and 100 FLM.

Rear Electrode

The rear electrode is placed on the back surface of the luminescent layer, that is, the insulating layer side. The rear electrode is in direct contact with the luminescent layer in the example of FIG. 1.

A resin layer can be provided between the rear electrode and the luminescent layer for increasing the adhesion between them. The resin for the resin layer may be a polymer with a high dielectric constant, which will be explained below. The resin layer may contain insulating organic particles.

The rear electrode may be a conductive film used in the conventional dispersion type EL devices, such as a metal film of aluminum, gold, silver, copper, nickel, chromium, etc.; a transparent conductive film such as an ITO film; and the like. The metal film may be a vapor deposited film, a sputtered film, a metal foil, and the like.

The thickness of the rear electrode is usually between 0.1 and 1000 $\mu$m.

The EL device can emit light from both surfaces, when the rear electrode consists of the transparent conductive film and the insulating layer is also transparent.

Formation of Luminescent Layer

The luminescent layer may be formed as follows:

The matrix resin comprising the polymer having the high dielectric constant, fluorescent particles and solvent are mixed and dispersed homogeneously with a kneading apparatus such as a homomixer, and a paint for the dispersion type luminescent layer is prepared. Then, it is coated and dried for forming the luminescent layer. In this case, the luminescent layer may be formed on a temporal support having releasing properties, and then transferred to either the transparent conductive layer or the rear electrode. The solid content of the paint is usually between 10 and 60 wt. %.

The coating means, coating thickness, drying conditions, and the like are the same as those in the formation of the conventional dispersion type luminescent layer.

The laminated luminance layer (that is, the laminate structure consisting of the support layer, luminescent particle layer and insulating layer) may be formed as follows:

Firstly, the luminescent particle layer is formed on the surface of either the support layer or the insulating layer by any conventional powder coating method.

For example, particles containing the luminescent particles are scattered on the substrate layer, while it maintains flowability, by a suitable method such as static suction, spraying, gravimetric scattering, and the like, and the luminescent particle layer in which a part or whole of the particles are embedded in the support layer is formed. After that, the flowability of the support layer is suppressed, and the support layer and the particle layer are bonded. For maintaining the flowability of the support layer, following methods are preferable: A method for maintaining the undried state of the coating layer formed from the paint for the support layer containing the solvent, A method for maintaining the support layer at a temperature higher than the softening or melting point of the resin for the support layer, and A method for adding a radiation-curable monomer to the paint for the support layer. These methods facilitate a solidifying procedure for suppressing the flowability of the support layer (drying, cooling or hardening).

In the same way, the luminescent particle layer can be formed on the insulating layer made of the coating layer.

The final layer (either the support layer or the insulating layer) is laminated on the luminescent particle layer which has been formed as above, and the laminate structure in which the three layers are bonded is formed. The final layer is preferably laminated by coating a paint containing materials for forming the final layer and solidifying it, or by press-bonding a film made of materials for forming the final layer. These methods can surely form the bonded structure without the presence of any bubble at the interface between each pair of the support layer, luminescent particle layer and insulating layer.

The luminescent particle layer consists of a plurality of particles which are placed in a single layer state and is bonded to both the support and insulating layers, in the example of FIG. 1.

However, the luminescent particle layer may be a multilayer, or a part or whole of the particles may be embedded entirely in either the support layer or the insulating layer. It is important to form a bonded structure in which the luminescent particle layer is placed between the support layer and the insulating layer, and no bubbles are present at the interface between each pair of the layers.

In the luminescent particle layer formed as above, the materials of the support or insulating layer penetrate in spaces between the particles. In such the case, a filling rate of the particles is usually at least 20 vol. %, preferably at least 30 vol. more preferably at least 40 vol. %, since the decrease of the filling rate may lead to the decrease of luminance.

Herein, the "filling rate of particles" is defined as a percentage of the total volume of the particles in the volume of a hypothetical layer comprising all the particles in the luminescent particle layer and the materials which are present between the particles.

Furthermore, each of the support and insulating layers may be a laminate of two or more layers, unless the effects of the present invention are impaired.

Support Layer

The support layer for the luminescent layer is placed preferably on the back surface of the transparent conductive layer in close contact therewith, and thereby the luminescent efticiency of the luminescent layer is easily increased.

The support layer is a transparent layer containing a matrix resin. The thickness of the support layer is usually between 5 and 1000 Km, and the light transmission is usually at least 70 preferably at least 80%.

The matrix resin may be a resin which is used in the conventional dispersion type EL devices such as epoxy resins, polymers having a high dielectric constant, and the like. The polymers having the high dielectric constant are those having a dielectric constant of usually at least about 5, preferably between 7 and 25, more preferably between 8 and 18, when it is measured by applying an alternating current of 1 kHz. When the dielectric constant is too low, the luminance may not increase. When it is too high the life of the luminescent layer tends to shorten.

Examples of the polymers having the high dielectric constant are vinylidene fluoride resins, cyanoresins, and the like. For example, the vinylidene fluoride resin may be obtained by copolymerization of vinylidene fluoride and at least one other fluorine-containing monomer. Examples of the other fluorine-containing monomer are tetrafluoroethylene, trifluorochloroethylene, hexafluoropropylene, and the like. Examples of the cyanoresin are cyanoethylcellulose, cyanoethylated ethylene-vinyl alcohol copolymer, and the like.

The support layer consists of the matrix resin in the embodiment of FIG. 1, while it may contain additives such as other resins, fillers, surfactants, UV light absorbers, antioxidants, antifungus agents, rust-preventives, moisture absorbents, colorants, phosphors, and the like, unless the effects of the present invention are impaired. For example, the support layer may contain red or pink fluorescent dyes such as rhodamine 6G, rhodamine B, perylene dyes, and the like, when the emitted light from the luminescent particle layer is blue-green. Furthermore, the above other resins may be curable or tacky.

Insulating Layer

The insulating material contained in the insulating layer of the luminescent layer may be insulating particles, polymer having a high dielectric constant, and the like, which are used in the conventional dispersion type EL devices.

The insulating layer in the embodiment of FIG. 1 is a coating layer formed from a paint which has been prepared by dispersing the insulating particles in the polymer having the high dielectric constant. Examples of the insulating particles are insulating inorganic particles of, for example, titanium dioxide, barium titanate, and the like. The polymers having the high dielectric constant may be the polymers used for the support layer.

The insulating layer may be formed by coating the paint on either the rear electrode or the luminescent particle layer.

When the insulating layer is the coating layer comprising the insulating particles and the polymer having the high dielectric constant, the amount of the insulating particles is between 1 and 400 wt. parts, preferably between 10 and 300 wt. parts, more preferably between 20 and 200 wt. parts, per 100 wt. parts of the polymer having the high dielectric constant. When the amount of the insulating particles is too low, the insulating effect decreases, and thus the luminance tends to decrease. When the amount is too high, the application of the paint may be difficult.

The thickness of the insulating layer is usually between 5 and 1000 $\mu$m. The insulating layer may contain additives such as fillers, surfactants, antioxidants, antifungus agents, rust preventives, moisture absorbents, colorants, phosphors, curable resins, tackifiers, and the like, insofar as the insulating properties are not impaired.

Luminescent Particle Layer

The luminescent particles in the luminescent particle layer spontaneously emit light when they are placed in an alternating electric field. As such the particles, fluorescent particles which are used in the conventional dispersion type EL devices can be used. Examples of the fluorescent materials are single substances of fluorescent Compounds (e.g. ZnS, CdZnS, ZnSSe, CdZnSe, etc.), or mixtures of the fluorescent compounds and auxiliary components (eg. Cu, I, Cl, AI, Mn, $NdF_3$, Ag, B, etc.).

The average particle size of the fluorescent particles is usually between 5 and 100 gm. The particulate fluorescent materials on which a coating film of glass, ceramics, and the like is formed may be used.

The thickness of the luminescent particle layer is usually between 5 and 500 Km. When the fluorescent particle layer consists of a plurality of particles which are placed in a single layer state, the EL device can be made thin easily.

Furthermore, the luminescent particle layer may contain at least two kinds of luminescent particles. For example, at least two kinds of luminescent particles which emit blue, blue-green or orange light and have discrete spectra each other are mixed, and thus a luminescent layer having the high whiteness can be formed.

The content of the luminescent particles in the luminescent particle layer is preferably at least 40 wt. %. When the content is less than 40 wt. %, the effects for improving the luminance may decrease. The luminance can be maximized when the particles consist of the luminescent particles. Accordingly, the particularly preferable content of the luminescent particles is between 50 and 100 wt. %.

The luminescent particle layer may contain one or more kinds of particles other than the luminescent particles, for example, particles of glass, coloring materials, phosphors, polymers, inorganic oxides, and the like. For example, luminescent particles which emit blue-green light and a pink-coloring material which is the complimentary color to blue-green (e.g. particles containing rhodamine 6G, rhodamine B, etc.) are mixed for forming the luminescent layer having the high whiteness.

Production of EL Device

Now, the production method of the present invention, which is suitable for the production of the described EL device comprising the above described laminate EL element, will be explained.

Firstly, the prismatic film, on which surface the transparent conductive layer has been laminated, is provided. A paint for forming the support layer is applied on the transparent conductive layer. After that, particles containing the luminescent particles are scattered in a layer state over the applied paint prior to drying of the paint, and the particle layer is partly embedded in the support layer, followed by drying of the paint. These steps can easily form the luminescent particle layer which is partially embedded in and bonded to the support layer.

The particles are embedded in the support layer so that usually 1 to 99%, preferably 10 to 90%, more preferably 20 to 80% of the size of each particle in the vertical direction (to the plane of the support layer) is embedded in the support layer. When the embedded percentage is less than 1%, the particle layer tends to be damaged during the formation of the insulating layer. When the particles are embedded so that the embedded percentage exceeds 99 the particle layer may not be formed uniformly.

The coating thickness of the paint for forming the support layer is selected so that the dry thickness of the support layer is in the above range. The solid content in the paint for forming the support layer is usually between 5 and 80 wt. %.

A solvent used in the paint is selected from conventional organic solvents so that the matrix resin is homogeneously dissolved.

The paint may be prepared with mixing or kneading apparatuses such as homomixers, sand mills, planetary mixers, and the like.

For applying the paint, coating apparatuses such as bar coaters, roll coaters, knife coaters, die coaters, and the like can be used.

The drying conditions depend on the kind of solvent in the paint and the solid content of the paint, and usually include a temperature in the range between room temperature (about 25° C.) and 150° C., and a drying time in the range between 5 seconds-and 1 hour.

The particles are scattered by the above method within one minute from the application of the paint for forming the support layer, which makes the embedding of particles easy. The drying degree of the paint depends on the wettability between the particles and the support layer, and is usually in the range between 10 and 95 wt. %, preferably between 20 and 90 wt. % in terms of the solid content.

Subsequently, the paint for forming the insulating layer is applied so that the luminescent particle layer is covered, and dried. Accordingly, a bonded structure, in which the luminescent particle layer is embedded in both the support and insulating layers and no bubble is present at the interface between each pair of the layers, is formed.

The coating thickness of the paint for forming the insulating layer is selected so that the dry thickness of the insulating layer is in the above range.

The solid content in the paint for forming the insulating layer is usually between 5 and 70 wt. %. A solvent used in the paint is selected from conventional organic solvents so that the insulating material is homogeneously dissolved or dispersed.

This paint may be prepared and applied using the same apparatuses or tools as those used for preparing and applying the paint for forming the support layer.

The drying conditions depend on the kind of solvent in the paint and the solid content of the paint, and usually include a temperature in the range between room temperature (about 25° C.) and 150° C., and a drying time in the range between 5 seconds and 1 hour.

Finally, the rear electrode is laminated on the insulating layer. The rear electrode may be formed by the above described methods. Among them, the methods for forming thin films in vacuum such as the vapor deposition and sputtering are preferable for effectively forming the rear electrode on the insulating layer, which has been dried after drying, with good adhesion between the rear electrode and the insulating layer.

The steps of the above described production method are substantially the same as those of a conventional method for producing a sheet-form product. Therefore, the sheet-form EL devices having a high luminance and a large area can be produced at high productivity using the production steps for the conventional sheet-form products. For example, a roll-form starting sheet of the prismatic film having a width of between 25 and 200 cm and a length of between 100 and 20,000 m is used, and the transparent conductive layer, support layer, luminescent particle layer, insulating layer and rear electrode are successively laminated on the sheet, and the sheet-form EL device having a large area is mass produced.

Furthermore, the problems caused by the use of dispersion paints are solved, since the above method does not use the dispersion paints of the luminescent particles.

The EL devices may be produced by an alternative method, which is analogous to the above method, comprising applying the paint for the insulating layer on the support including the rear electrode, scattering the luminescent particles prior to drying of the applied paint, embedding a part of the particle layer in the insulating layer, then, drying the paint for the insulating layer, applying and drying the paint for the support layer, and finally laminating the prismatic film which carries the transparent conductive layer. This method has the same effects as the above described method.

Application of EL Device

The EL device of the present invention can be used as a back-light source for liquid crystal displays such as liquid crystal instrument panels of automobiles. In addition, the EL device of the present invention can be used as a light source for internal illuminating type displays such as billboards, road signs, decorative displays, and the like.

For example, images such as characters, designs, and the like are printed on the surface of a light-transmitting sheet, and the sheet is placed on the EL device with the back surface of the sheet facing the light-emitting side of the EL device. The light transmitting sheet may be made of the same material as that of the above transparent substrate, and has a light transmission of at least 20%. In this case, the back surface of the sheet and the light emitting side of the EL device are not bonded each other preferably.

Alternatively, a prism type retroreflective sheet may be used as the light-transmitting sheet. The combination with the retroreflective sheet can impart both the retroreflectivity and the self-light-emitting properties to the EL device built-in type display.

Light is emitted from the EL device by connecting two terminals, which are in connection with the transparent conductive layer and the rear electrode layer, respectively, to a power source, and applying a voltage to the EL device.

As the power source, cells such as dry cells, batteries, solar cells, etc. may be used, or an alternating current is supplied to the EL device from a power line through an invertor, which alters the voltage or frequency, or change the current between the alternating current and the direct current. The applied voltage is usually between 3 and 200 V.

The laminate type EL device has the high light-emitting efficiency, and therefore emits light with sufficient luminance (for example, 50 cd/m$^2$ or higher) at a lower voltage (for example, 100 V or lower) than that necessary for the conventional dispersion type ones.

When the EL device is used outdoors, it is preferably covered with water-capturing films made of, for example, polyamide resins, or moistureproof films made of, for example, polytetrafluoroethylene.

EXAMPLES

Example 1

Production of EL Device

A brightness enhancement film "BEF 1190/50" (trade name) manufactured by 3M was used as a prismatic film, and a transparent conductive layer consisting of ITO was coated directly on the flat surface of the film by sputtering.

This prismatic film comprises a flat substrate of a PET film and a lens layer consisting of a plurality of prismatic ridges made of an acrylic resin and arranged in parallel with each other on one surface of the substrate. The height from the back surface of the substrate to the apexes the prismatic ridges was 155 μm, the prism angle (the angle of the apex of the ridge) was 90 degrees, and the prism pitch was 50 μm. The thickness of the ITO layer was 550 μm, and the surface resistivity was 250 Ω/square.

The dispersion type luminescent layer was formed as follows:

A paint for forming the luminescent layer was prepared by mixing and uniformly dispersing a polymer having a high dielectric constant (100 wt. parts), luminescent particles (150 wt. parts) and ethyl acetate. The solid content of this paint was about 45 wt. %.

This paint was coated on the transparent conductive layer, which had been formed on the prismatic film, with a knife coater, and dried at about 65° C. for about 1 minute. The dry thickness of the luminescent layer was 30 μm.

The used polymer having the high dielectric constant was a tetrafluoroethylene-hexafluoropropylene-vinylidene fluoride copolymer ("THV 200" (trade name) manufactured by 3M), which has a dielectric constant of 8 (at 1 kHz) and a light transmission of 96%.

The used luminescent particles were ZnS luminescent particles "S-728" (trade name) manufactured by OSRAM SYLVANIA (average particle size of about 23 μm).

Next, a paint for forming an insulating layer was applied so that the paint covered the luminescent layer and dried, and an insulating layer was formed.

The paint for forming the insulating layer was prepared in the same manner as that for the paint for forming the luminescent layer except that the polymer having the high dielectric constant (THV 200 P described above), insulating particles (barium titanate manufactured by KANTO KAGAKU) and ethyl acetate were mixed. The weight ratio ot the polymer to the insulating particles was 100:80, and the solid content of the paint was about 38 wt. %. The paint was applied with a knife coater, and the drying conditions included a temperature of about 65° C. and a drying time of about one minute. The dry thickness of the insulating layer was 15 μm.

Finally, a rear electrode layer made of aluminum was laminated on the insulating layer by vacuum deposition, and a film form EL device of this Example was obtained. In this step, the vacuum deposition was carried out using a vacuum deposition apparatus "EBV-6DA" (manufactured by ULVAC) under a chamber pressure of $10^{-5}$ Torr or less for a deposition time of 5 seconds.

Light Emission From EL Device

Respective terminals were attached to the transparent conductive layer and the rear electrode layer of the EL device of this Example (prepared by cutting the above sheet-from device in a square of 100 mm×100 mm), and were joined to a power source (PCR 500L manufactured by KIKUSUI ELECTRONIC INDUSTRIES, Ltd.). Then, the alternating voltage was applied to the device under conditions of 120 V, 600 Hz. The EL device emitted light uniformly.

The EL device was placed in a dark room, and the luminance was measured at a distance of 1 meter from the surface of the prismatic film using a luminance meter (LS 110 manufactured by MINOLTA). The results are shown in Table 1.

Comparative Example 1

An EL device of this Comparative Examples was produced in the same manner as in Example 1 except that a transparent film both surfaces of which are flat ("TCR-KPC 300-75 (A)" (trade name) manufactured by OIKE Industries, Ltd. thickness of 75 μm and a light transmission of 81%) was used in place of the prismatic film.

The luminance of this EL device was measured in the same manner as in Example 1. The results are shown in Table 1.

Example 2

An EL device of this Example was produced in the same manner as in Example 1 except that a laminate luminescent layer was formed by the following method in place of the dispersion type luminescent layer:

The same polymer having the high dielectric constant as used in Example 1 and ethyl acetate were mixed and uniformly dispersed using a homomixer, and a paint for forming a support layer was prepared. The solid content of this paint was about 25 wt.

This paint was applied on the transparent conductive layer which had been formed on the prismatic film. Luminescent particles were scattered over the applied paint in substantially the single layer state prior to drying of the paint, and embedded in the paint so that about 50% of the diameter sunk. After that, the paint was dried. The paint was applied using a knife coater, and the particles were scattered just after the application of the paint. The drying conditions included a temperature of about 65° C. and a drying time of about 1 minutes. The luminescent particles were the same as those used in Example 1.

Subsequently, the same paint for forming the insulating layer as used in Example 1 was applied so that it covered the luminescent particle layer, and dried, and the insulating layer was formed. The coating and drying conditions were the same as those in Example 1.

The above steps formed the bonded structure in which the luminescent particle layer was embedded both in the support and insulating layers, and substantially no bobbles were present at the interface between each pair of layers.

The dry thickness of the luminescent layer was 45 μm.

An alternating current was applied to the EL device produced in this Example in the same way except that the application conditions were 100 V and 400 Hz—The EL device emitted light brightly and uniformly.

The luminance of the EL device of this Example was measured in the same manner as in Example 1 except the above current application conditions were used. The results are shown in Table 1.

Comparative Example 2

An EL device of this Comparative Example was prepared in the same manner as in Example 2 except that the same transparent film as used in Comparative Example 1 was used. The luminance of the EL device of this Example was measured in the same manner as in Example 2. The results are shown in Table 1.

Comparative Example 3

An EL device of this Comparative Example was produced by placing the same prismatic film as used in Example 1 on the surface of the transparent film of the EL device produced in Comparative Example 2 (used as an EL element) with the flat surface of the prismatic film facing the light-emitting surface of the EL device. The EL device produced in this Comparative Example had a thin air layer at the interface between the light-emitting surface of the EL element and the prismatic film. The luminance of the EL device of this Comparative Example was measured in the same manner as in Example 2. The results are shown in Table 1.

TABLE 1

| | Structure of luminance layer | Prismatic film | Luminance (cd/m$^2$) |
|---|---|---|---|
| Example 1 | Dispersion | Yes | 52.0 |
| C. Ex. 1 | Dispersion | No | 44.4 |
| Example 2 | Scattering | Yes | 53.2 |
| C. Ex. 2 | Scattering | No | 40.0 |
| C Ex. 3 | Scattering | Yes | 47.0 |

Using the EL devices produced in Example 2 and Comparative Example 3, the luminance in directions which deviate at angles of 0, 25, 30, 45 and 60 degrees from the normal line to the prismatic film (the flat surface) was measured in the same manner as described above. The results are shown in Table 2 and FIG. 2.

With the EL device of the present invention (Example 2), the sufficient luminance was attained even at the observation angles larger than 25 degrees, while with the conventional EL device (Comparative Example 2), the luminance decreased apparently at the observation angles larger than 25 degrees.

TABLE 2

| | Prismatic film and luminance layer | Observation angle (deg.) | | | | |
|---|---|---|---|---|---|---|
| Ex. 2 | Bonded | 53.2 | 46.7 | 36.8 | 24.2 | 28.8 |
| C. Ex. 2 | Separated | 47.0 | 37.8 | 15.9 | 3.0 | 16.6 |

Effects of the Invention

The present invention provides the EL device which can effectively intensify the light which is emitted in the normal line direction and also in the direction deviating from the normal line, and increase the luminance in the wide observation angle range.

The invention is not limited to the above embodiments. The claims follow.

What is claimed is:

1. An electroluminescent device comprising: an electroluminescent element having a light-emitting surface, and a prismatic film having a surface on which a plurality of prisms are provided and a back surface opposed to said surface and being placed on said light-emitting surface, where the back surface of the prismatic film and said light-emitting surface of the electroluminescent element are closely bonded optically.

2. An electroluminescent device as claimed in claim 1, wherein said electroluminescent element comprises:

a) a transparent conductive layer having a surface facing said back surface of the prismatic film, b) a luminescent layer placed on the back surface of said transparent conductive layer, and c) a rear electrode placed on the back surface of said luminescent layer, and said luminescent layer comprises:

(c-1) a support layer comprising a matrix resin and being placed on the side of the transparent electrode layer, (c-2) an insulating layer comprising an insulating material and being placed on the side of the rear electrode, and (c-3) a luminescent particle layer comprising particles which are being embedded in both the support layer and the insulating layer, in which said particles contain luminescent particles.

3. A method for producing an electroluminescent device as claimed in claim 2, comprising steps of:

i) providing a prismatic film on the back surface of which a transparent conductive layer is laminated, ii) applying a paint for forming a support layer containing matrix resin on said transparent conductive layer, scattering particles containing luminescent particles in a layer state, and embedding a part of each particle in said paint prior to solidification of said paint, then, solidifying said paint and forming a transparent support layer and a luminescent particle layer (4) bonded to said support layer, iii) applying a paint for forming an insulating layer comprising an insulating material on said luminescent particle layer, solidifying said paint and forming said insulating layer bonded to said luminescent particle layer, and iv) laminating a rear electrode on said insulating layer.

4. An electroluminescent device comprising:

an electroluminescent element having a light-emitting surface, and a prismatic film closely bonder optically to the light emitting surface of the electroluminescent element.

5. The electroluminescent device of claim 4, wherein the prismatic film is bonded to the light emitting surface of the electroluminescent element such that substantially no air is present between the prismatic film and the light emitting surface.

6. The electroluminescent device of claim 4, wherein the prismatic film is bonded to the light emitting surface via a transparent adhesive layer leaving substantially no air between the prismatic film and the electroluminescent element.

7. The electroluminescent device of claim 4, wherein the electroluminescent element includes a transparent conductive layer which is coated on the prismatic film.

8. The electroluminescent device of claim 4, wherein a prism angle of the prismatic film is between 70 and 120 degrees.

9. The electroluminescent device of claim 4, wherein the prismatic film is a multilayer prismatic film.

10. The electroluminescent device of claim 9, wherein at least one layer of the multilayer prismatic film has a high transparency and contains a dye which develops a complimentary color to a color emitted by the electroluminescent element.

11. The electroluminescent device of claim 4, wherein the prismatic film includes triangular prisms.

12. The electroluminescent device of claim 4, wherein the prismatic film includes cube-corner prisms.

13. The electroluminescent device of claim 4, wherein the electroluminescent device exhibits a luminance greater than 50 candelas per meter squared.

14. The electroluminescent device of claim 4, wherein the electroluminescent device exhibits a luminance greater than 40 candelas per meter squared at an observation angle of at least 25 degrees.

15. The electroluminescent device of claim 4, wherein the electroluminescent device exhibits a luminance greater than 30 candelas per meter squared at an observation angle of at least 30 degrees.

16. The electroluminescent device of claim 4, wherein the electroluminescent device exhibits a luminance greater than 20 candelas per meter squared at an observation angle of at least 45 degrees.

17. The electroluminescent device of claim 4, wherein the electroluminescent device exhibits a luminance greater than 20 candelas per meter squared at an observation angle of at least 60 degrees.

18. A method comprising optically bonding a light emitting surface of an electroluminescent element to a prismatic film such that substantially no air layer is present between the light emitting surface and the prismatic film.

19. The method of claim 18, wherein optically bonding the light emitting surface to the prismatic film comprises adhering the prismatic film to the light emitting surface using a transparent adhesive layer.

20. The method of claim 18, wherein optically bonding the light emitting surface to the prismatic film comprises:

coating a transparent conducting layer of the electroluminescent element directly on a back surface of the prismatic film; and forming a luminescent layer of the electroluminescent element in close contact with a back surface of the transparent conductive layer.

* * * * *

UNITED STATES PATENT AND TRADEMARK OFFICE

CERTIFICATE OF CORRECTION

PATENT NO. : 6,617,784 B1
DATED : September 9, 2003
INVENTOR(S) : Abe, Hidetoshi It is certified that error appears in the above-identified patent and that said Letters Patent is hereby corrected as shown below:

Column 1,
Line 22, “resln” should be -- resin --.
Line 31, “toil” should be -- coil --.
Line 33, delete “the” preceding “both”
Line 49, “intensity” should be -- intensify --.
Line 53, delete “a” preceding “results”.

Column 3,
Line 31, “are” should be -- is --.
Line 56, delete “the” preceding “prismatic”.
Line 56, “film” should be -- films --.

Column 4,
Line 26, “complimentary” should be -- complementary --.
Line 28, delete “the” preceding “dye”.
Line 40, “effect” should be -- effects --.
Lines 55-56, “92/square” and “U/square” should be -- .Ω/square --.
Line 66, “the structure” should be -- a structure --.

Column 5,
Line 14, “or,primer” should be -- or, primer --.

Column 6,
Line 4, insert -- the -- preceding “following”.
Lines 7 and 10, “,A” should be -- ; a --.
Line 10, “, and A” should be -- ; and a --.
Line 60, “efticiency” should be -- efficiency --.

Column 7,
Line 6, insert -- , -- following “high”.

Column 8,
Line 19, “each other are mixed” should be -- are mixed with each other --.

Column 10,
Line 28, insert -- to -- following “bonded”.
Line 42, “invertor” should be -- inverter --.

UNITED STATES PATENT AND TRADEMARK OFFICE

CERTIFICATE OF CORRECTION

PATENT NO. : 6,617,784 B1
DATED : September 9, 2003
INVENTOR(S) : Abe, Hidetoshi It is certified that error appears in the above-identified patent and that said Letters Patent is hereby corrected as shown below:

Column 11,
Line 1, insert -- of -- following "apexes".
Line 35, "ot" should be -- to --.
Line 53, "sheet-from" should be -- sheet-form --.
Line 66, "Examples" should be -- Example --.

Column 12,
Line 19, "wt." should be -- wt % --.
Line 29, "minutes" should be -- minute --.
Line 39, "bobbles" should be -- bubbles --.

Column 14,
Line 30, "bonder" should be -- bonded --.
Lines 52-53, "complimentary" should be -- complementary --.

Signed and Sealed this

Second Day of March, 2004

JON W. DUDAS
*Acting Director of the United States Patent and Trademark Office*